US012552495B2

(12) United States Patent
Johnston et al.

(10) Patent No.: US 12,552,495 B2
(45) Date of Patent: Feb. 17, 2026

(54) MODULAR HYDROFOIL SYSTEM FOR WATERCRAFT

(71) Applicants: Robert Martin Johnston, Hood River, OR (US); Gabriel Verrier-Paquette, Hood River, OR (US); Tony Logosz, Hood River, OR (US)

(72) Inventors: Robert Martin Johnston, Hood River, OR (US); Gabriel Verrier-Paquette, Hood River, OR (US); Tony Logosz, Hood River, OR (US)

( * ) Notice: Subject to any disclaimer, the term of this patent is extended or adjusted under 35 U.S.C. 154(b) by 477 days.

(21) Appl. No.: 18/144,605

(22) Filed: May 8, 2023

(65) Prior Publication Data

US 2023/0356804 A1 Nov. 9, 2023

(51) Int. Cl.
*B63B 1/28* (2006.01)

(52) U.S. Cl.
CPC ..... *B63B 1/285* (2013.01); *B63B 2221/00* (2013.01); *B63B 2221/08* (2013.01)

(58) Field of Classification Search
CPC .... B63B 1/00; B63B 1/16; B63B 1/18; B63B 1/20; B63B 1/22; B63B 1/24; B63B 1/242; B63B 1/248; B63B 1/26; B63B 1/28; B63B 2221/00; B63B 2221/08; B63B 2221/20; B63B 2221/24
USPC ..... 114/271, 272, 273, 274, 278, 280
See application file for complete search history.

(56) References Cited

U.S. PATENT DOCUMENTS

| | | | | |
|---|---|---|---|---|
| 7,980,191 | B2 * | 7/2011 | Murphy | B63B 1/16 114/274 |
| 9,085,343 | B2 * | 7/2015 | Modica | B63B 32/66 |
| 9,278,739 | B2 * | 3/2016 | Salles | B63B 32/64 |
| 10,358,193 | B2 * | 7/2019 | Lobisser | B63B 32/64 |
| 10,668,987 | B1 * | 6/2020 | Murphy | B63B 1/244 |
| 10,988,216 | B1 * | 4/2021 | Murphy | B63B 32/50 |
| 11,130,549 | B2 * | 9/2021 | Dombois | B63B 1/248 |
| 11,345,449 | B2 * | 5/2022 | Sommerlatt | B63B 32/66 |
| 11,731,741 | B2 * | 8/2023 | Hagen | B63B 32/10 114/274 |
| 2020/0102052 | A1 * | 4/2020 | Geislinger | B63B 1/28 |

* cited by examiner

*Primary Examiner* — Daniel V Venne

(57) ABSTRACT

A hydrofoil system for a hydrofoil equipped watercraft with cooperating fuselage portion that have tapered sections. The tapered sections are configured to form an overlapping stacked wedge within an inner passageway of a collar so that the collar frictionally engages the stacked tapered sections when the first fuselage portion and the second fuselage portion are drawn together longitudinally.

20 Claims, 6 Drawing Sheets

MODULAR HYDROFOIL SYSTEM FOR WATERCRAFT

FIELD OF THE PRESENT INVENTION

The present invention relates generally to use of a hydrofoil with a watercraft, such as a surfboard, windsurf board, kite board, or the like. More particularly, aspects of the disclosure focus on techniques for securing components of the hydrofoil together in a robust, reliable and expedited manner.

BACKGROUND OF THE INVENTION

Hydrofoils are wings that are adapted to function in water as opposed to air but share many similar attributes. Notably, a hydrofoil provides a significant amount of lift, even at relatively slow speeds. Accordingly, the benefits of a hydrofoil may be extended to any number of applications involving movement through the water. For example, nearly any recreational pursuit that involves riding a board may take advantage of a hydrofoil, including kitesurfing, wind surfing, stand up paddle boarding, wake boarding, water skiing, tow-in surfing, conventional surfing and others. For context, FIG. 1 shows one embodiment of a board 10 that may be equipped with a hydrofoil 12. Again, virtually any craft that may be ridden or propelled through water may benefit from the techniques of this disclosure. As shown in greater detail in FIG. 2, the hydrofoil assembly 12 generally includes a mast 14 that extends from the board 10 (not shown in this view) to a fuselage 16. The length of mast 14 may be varied to alter handling characteristics as known in the art. Generally, a longer mast allows for the board to be lifted relatively higher from the surface of the water when the hydrofoil is "flying" and generating sufficient lift. As a result, the board is isolated from the surface conditions, including chop and other disturbances. However, a longer mast may be more difficult to control for the rider, such that a relatively shorter mast be beneficial, particularly for those learning. In turn, a fore wing 18 and an aft wing or stabilizer 20 may be mounted to fuselage 16. As implied by the names, the fore and aft wings provide the lift generated by hydrofoil 12. Many different designs, combinations and/or configurations of these components may be employed, any of which may be utilized when implementing the techniques of this disclosure.

In conventional designs, the various components of the hydrofoil assembly 12 are secured together with threaded fasteners such as screws or bolts, allowing for disassembly and for interchanging components that may have different performance characteristics. It should also be appreciated that the connections must be sufficiently robust to withstand the forces developed during use, as the foil is supporting the body weight of the user and board 10 as well as being subject to dynamic loads associated with turning, jumping, pumping and/or others when being ridden. Moreover, it is desirable for the connections between the foil components to be as tight as possible with minimal or no play when secured. As one illustration, a number of conventional designs utilize bolts 22 (shown in phantom) to secure fuselage 16 to mast 14. Despite their common use, it is well-recognized that such threaded, metallic connections suffer from a number of drawbacks. Notably, threads are a common failure point in foils as they are prone to corrosion and seizing due to salt water and sand. Ionic reactions between the metallic alloys used for the threaded connections may cause them to fuse together, making disassembly difficult or impossible. Screws also tend to snap or break due to heavy use. Further, employing threaded connectors requires the user to carry appropriate tools in order to assemble or disassemble the foil.

One attempt to address some of these issues is disclosed in U.S. Pat. No. 9,278,739, which uses a male connector on the front wing that fits within a female receptacle carried by the mast. A threaded rod extends through a central bore and engages the rear portion of fuselage so that tightening the rod draws the male and female portions together to form a rigid connection. Although this design provides a secure attachment of the front wing to the mast, it must be noted that no direct engagement between front wing assembly and the stabilizer assembly is provided, as it is the female receptacles on the mast that receive the respective assemblies. As another consequence of this design, the stresses are constrained to relatively small overall portions of the mast engagement. Further, this design requires the use of a threaded connection to provide a substantial amount of the force needed to secure the components as well as the necessity of a separate tool to assemble and disassemble the foil.

As such, it would be desirable to provide a foil and mast system that allows assembly and disassembly but nevertheless results in a robust connection between all the separate components. Similarly, it would be desirable to optimize engagement among the separate components to distribute forces more effectively. In some situations, it may also be desirable to provide a foil system that allows relative fore and aft adjustment of the front wing and stabilizer relative to the mast to vary performance characteristics. Still further, it would be desirable to employ a foil system that enables tool free foil assembly, in some cases without requiring threaded connectors while still providing a robust connection between the front wing, mast and other components of the foil.

SUMMARY

This disclosure includes hydrofoil system with a first fuselage portion having a tapered section, a second fuselage portion having a tapered section, a collar having an inner passageway dimensioned to encompass and retain the tapered section of the first fuselage portion and the tapered section of the second fuselage portion when overlapped in a stacked wedge configuration and an actuator configured to draw the first fuselage portion and the second fuselage portion together longitudinally so that the collar frictionally engages the stacked tapered sections.

In one aspect, the actuator may be a manually-operated lever that imparts a force that pulls the first fuselage portion and second fuselage portion towards each other. A relative movement imparted to the first fuselage portion and second fuselage portion by the actuator may be adjustable.

In one aspect, the tapered section of the first fuselage portion and the tapered section of the second fuselage portion each have an equivalent length. The equivalent lengths of the tapered section of the first fuselage portion and the tapered section of the second fuselage portion may be at least as long as a length of the collar passageway.

In one aspect, a position of the stacked tapered sections may be longitudinally adjustable within the collar.

In one aspect, at least one of the first fuselage portion and the second fuselage portion may be a hydrofoil wing. One of the first fuselage portion and the second fuselage portion may be a fore wing and another of the first fuselage portion and the second fuselage portion may be an aft wing.

In one aspect, the actuator may engage the first fuselage portion and the second fuselage portion.

In one aspect, the actuator may engage the collar and one of the first fuselage portion and the second fuselage portion and the collar may resist longitudinal movement of another of the first fuselage portion and the second fuselage portion.

In one aspect, the tapered sections of the first fuselage portion and the second fuselage portion may have a planar profile. Alternatively, the tapered sections of the first fuselage portion and the second fuselage portion may have a three-dimensional profile.

In one aspect, the actuator comprises a lever secured to one of the first fuselage portion and the second fuselage portion and wherein the lever is configured to apply tension to a line secured to another of the first fuselage portion and the second fuselage portion.

In one aspect, the actuator may be a threaded rod.

This disclosure also includes a fuselage portion for a hydrofoil system having a tapered section configured to overlap with a tapered section of another fuselage portion to form a stacked wedge such that the stacked tapered sections are configured to be retained by an inner passageway of a collar, wherein the fuselage portion further comprises at least one of actuator and a means for engaging an actuator, wherein the actuator is configured to draw the fuselage portion and the another fuselage portion together longitudinally. The fuselage portion may have a hydrofoil wing.

This disclosure also includes a collar for a hydrofoil system having an inner passageway dimensioned to encompass and retain a tapered section of a first fuselage portion and a tapered section of the second fuselage portion when overlapped in a stacked wedge configuration.

This disclosure also includes a method for assembling a hydrofoil system. The method may involve providing a first fuselage portion having a tapered section, providing a second fuselage portion having a tapered section, overlapping the tapered section of the first fuselage portion and the tapered section of the second fuselage portion in a stacked wedge configuration within a collar having an inner passageway and drawing the first fuselage portion and the second fuselage portion together longitudinally so that the collar frictionally engages the stacked tapered sections.

In one aspect, drawing the first fuselage portion and the second fuselage portion together may involve manually operating an actuator to impart a force that pulls the first fuselage portion and second fuselage portion towards each other.

In one aspect, drawing the first fuselage portion and the second fuselage portion together may involve tightening a threaded connection.

BRIEF DESCRIPTION OF THE DRAWINGS

Further features and advantages will become apparent from the following and more particular description of the preferred embodiments of the disclosure, as illustrated in the accompanying drawings, and in which like referenced characters generally refer to the same parts or elements throughout the views, and in which.

DESCRIPTION OF THE INVENTION

Before describing the present invention in detail, it is to be understood that this invention is not limited to particularly exemplified materials, methods or structures as such may, of course, vary. Thus, although a number of materials and methods similar or equivalent to those described herein can be used in the practice of the present invention, the preferred materials and methods are described herein.

It is also to be understood that the terminology used herein is for the purpose of describing particular embodiments of the invention only and is not intended to be limiting.

Unless defined otherwise, all technical and scientific terms used herein have the same meaning as commonly understood by one having ordinary skill in the art to which the invention pertains.

Further, all publications, patents and patent applications cited herein, whether supra or infra, are hereby incorporated by reference in their entirety.

Finally, as used in this specification and the appended claims, the singular forms "a, "an" and "the" include plural referents unless the content clearly dictates otherwise.

Described herein are certain exemplary embodiments. However, one skilled in the art that pertains to the present embodiments will understand that the principles of this disclosure can be extended easily with appropriate modifications to other applications.

Figure 1:
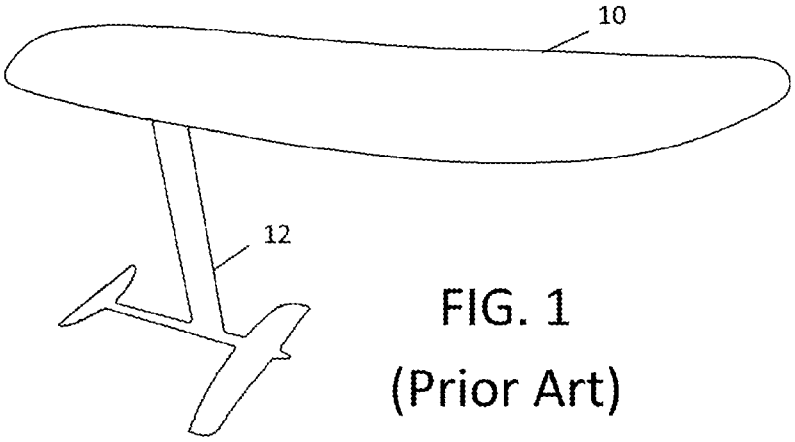
FIG. 1 (Prior Art)
FIG. 1 is an elevational view of a watercraft board and hydrofoil assembly as known in the prior art.
Figure 2:
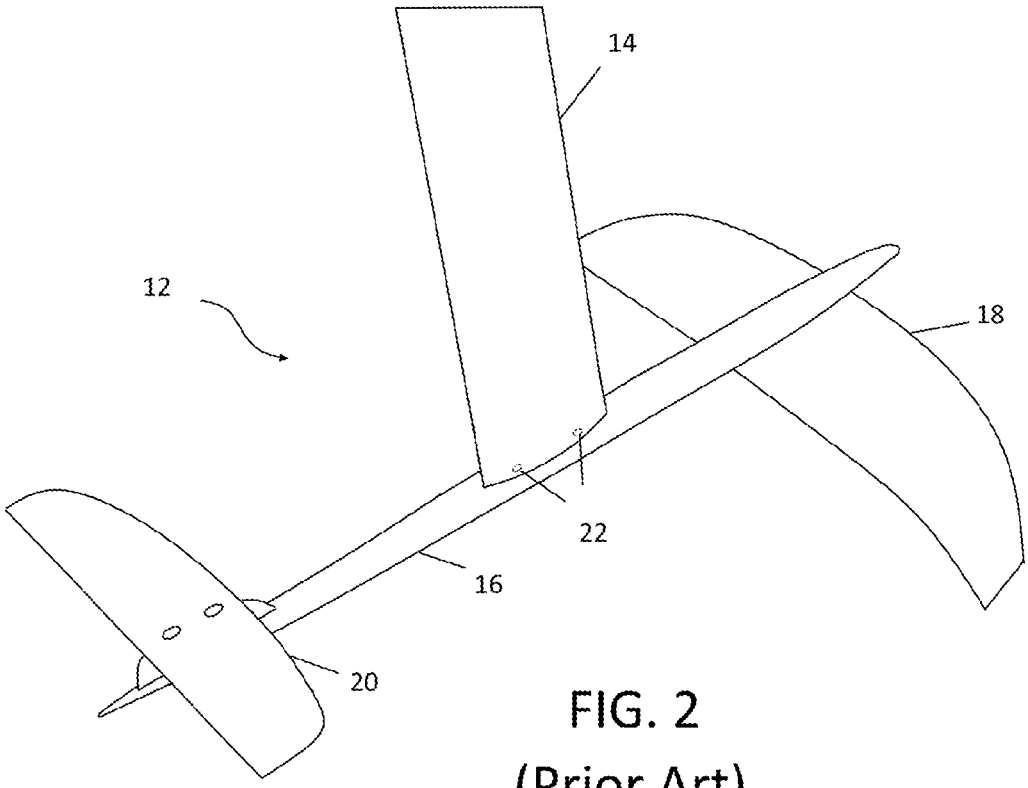
FIG. 2 (Prior Art)
FIG. 2 is an elevational view of components of the hydrofoil assembly of FIG. 1.
Figure 3:
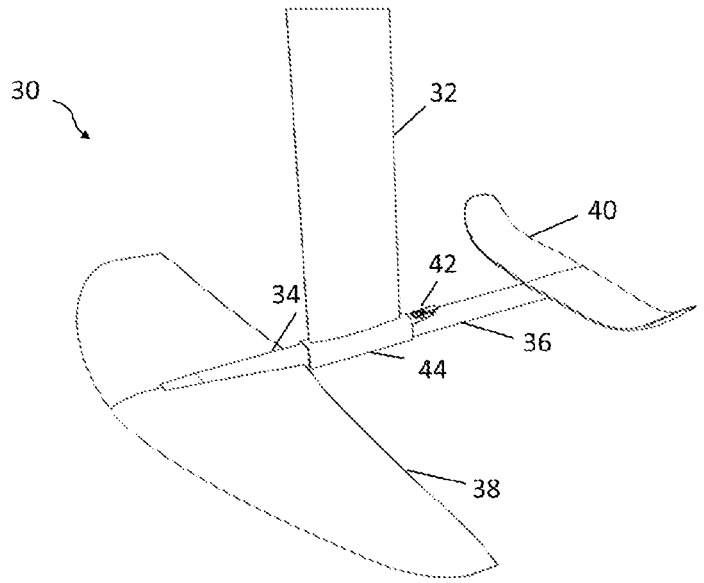
FIG. 3 is an elevational view of an assembled hydrofoil according to an embodiment of this disclosure.
Figure 4:
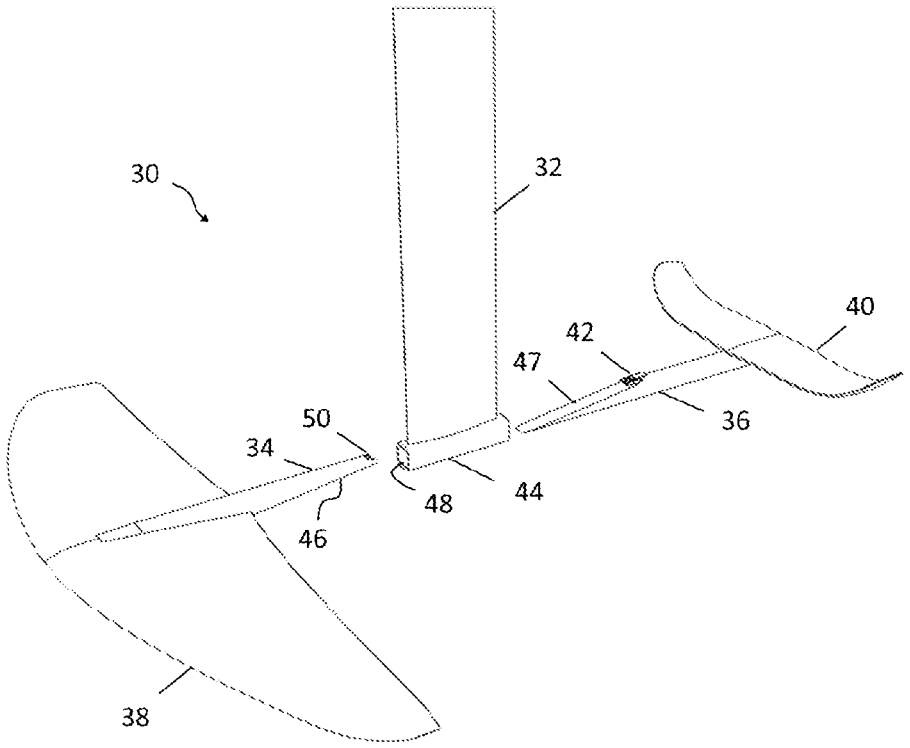
FIG. 4 is an elevational view of a disassembled hydrofoil showing complementary tapered portions according to an embodiment of this disclosure.

To help illustrate aspects of the disclosure, reference is first made to FIGS. 3-4 that depict hydrofoil system 30, including mast 32, front fuselage 34 and rear fuselage 36. As desired, either or both front fuselage 34 and rear fuselage 36 can feature integrated front wing 38 and rear wing or stabilizer 40, respectively. However, it should also be appreciated that likewise either or both front wing 38 and stabilizer 40 may be separate components to allow interchangeability or replacement and may be secured to the respective fuselage portions in any suitable manner, such as by threaded screws or bolts. Front fuselage 34 and rear fuselage 36 wing are drawn together longitudinally by actuator 42 with a single operation and retained within collar 44 of mast 32 as discussed in further detail below.

Particularly as shown in the exploded view of FIG. 4, front fuselage 34 and rear fuselage 36 feature complementary tapered portions 46 and 47 so that they form a splice connection having a stacked wedge configuration as they are drawn together longitudinally. Collar 44 has a straight passageway in the form of aperture 48 that is sized and configured to conform closely to the outer profile of stacked tapered portions 46 and 47. Collar 44 may be formed as an integral portion of mast 32 or may be a separate component that is then attached to mast 32, either permanently or removably. In one embodiment, aperture 48 may define an inner perimeter that is substantially the same as the outer perimeter of stacked tapered portions 46 and 47 when front fuselage 34 and rear fuselage 36 are in a desired relative longitudinal relationship. For example, each tapered portions 46 may be of the same length so that when aligned with each other, the stacked configuration presents a straight profile at least over the length of the overlap. As a result, collar 44 may encompass at least a portion of the stacked configuration such that a longitudinal, compressive tension applied to front fuselage 34 and rear fuselage 36 causes the stacked tapered portions 46 and 47 to generate an expansion force that locks the assembly together. Correspondingly, this embodiment allows the components to be quickly assembled and disassembled without the need for any specific tools.

As will be appreciated, the straight profile of aperture 48 of collar 44 allows engagement along its entire length, such that when tapered portions 46 and 47 are at least as long as the collar, forces from each component can be distributed along their respective lengths, providing a superior connection. For example, the load forces can be transmitted from the front wing to the mast over the entire length of the collar to resist breakage or failure especially during high load cases such as jumping or pumping.

The necessary compressive tension is applied by actuator 42, which in one embodiment is a cam latch that engages fitting 50 and may be spring-loaded as desired. In other embodiments, any suitable connection between front fuselage 34 and rear fuselage 36 that generates a compressive longitudinal force may be used, such as clips, bungees or lever and line or wire systems. Further, threaded connections can also be employed. Even though they suffer from certain drawbacks as discussed above, they still enable the other benefits provided by the techniques of this disclosure. When threaded connections are used, they may optionally have a portion configured to allow manual manipulation and hand tightening to avoid the need for a tool during assembly or disassembly. The straight configuration of collar 44 also facilitates manufacture, such as by allowing the collar to be formed by extrusion.

Figure 5:
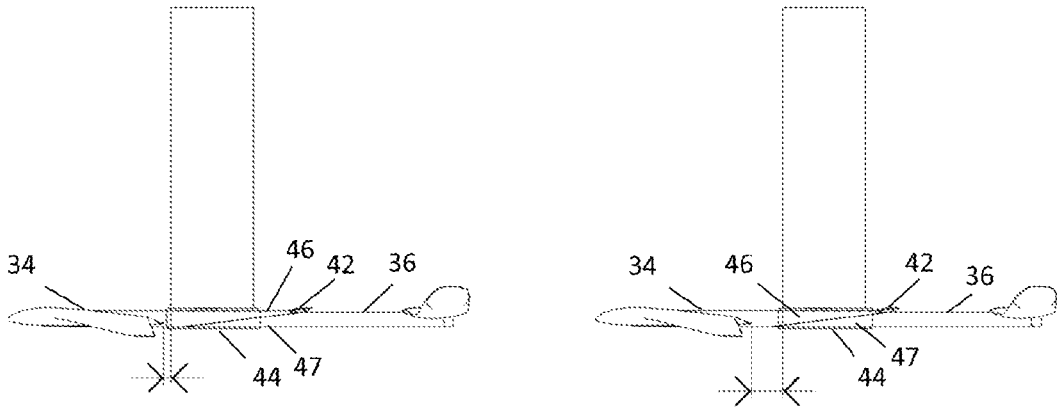
FIG. 5 is a schematic view showing adjustment of the relative positioning of stacked tapered portions within a collar according to an embodiment of this disclosure.

In one aspect, the techniques of this disclosure allow front fuselage 34 and rear fuselage 36 to have adjustable longitudinal positions relative to mast 32 as schematically depicted in FIG. 5. Specifically, the stacked tapered portions 46 and 47 may be slid fore and aft within collar 44 until the desired position is achieved and then locked in that position by engaging actuator 42 to apply the compressive longitudinal force. The straight female section of collar 44 allows for the splice of stacked tapered portions 46 and 47 to be tightened at different locations, in turn allowing the location of collar 44 and therefore mast 32 in relation to the fuselage and wings to be adjusted. This allows for the balance and ride characteristics of the fuselage to be easily adjusted without needing to change the fuselage. Notably, increasing the length of stacked tapered portions 46 relative to the length of collar 44 can provide a greater range of adjustment. Moreover, so long as the length of stacked tapered portions 46 and 47 is greater than the length of collar 44, forces from each component can be borne by the entire collar structure and the maximum engagement possible with both front fuselage 34 and rear fuselage 36 given the length of collar 44 may be achieved. Nevertheless, so long as collar 44 overlaps at least some portion of the configuration of stacked tapered portions 46 and 47, then the application of compressive longitudinal force will operate to lock the components together, for example if other design constraints do not allow complete overlap.

Figure 6:
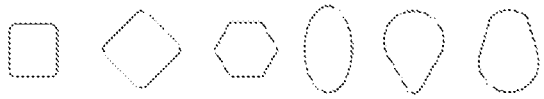
FIG. 6 schematically depicts alternative cross-sectional profiles of stacked tapered portions according to various embodiments of this disclosure.

As discussed above, the outer profile of stacked tapered portions 46 and the complementary inner profile of aperture 48 may be relatively straight along their respective length but in cross section may have a variety of different configurations, examples of which are depicted in FIG. 6. Relatively simple square, rectangular or trapezoidal configurations resist axial rotation of front fuselage 34 and rear fuselage 36 within collar 44, but ovalized or other rounded configurations may also be employed. For example, more angular shapes may increase rotation resistance while more rounded shapes may improve hydrodynamics and all are within the scope of this disclosure. Further, the shapes may be asymmetric also to resist rotation or if warranted to provide different strength characteristics to accommodate expected forces.

Figure 7:
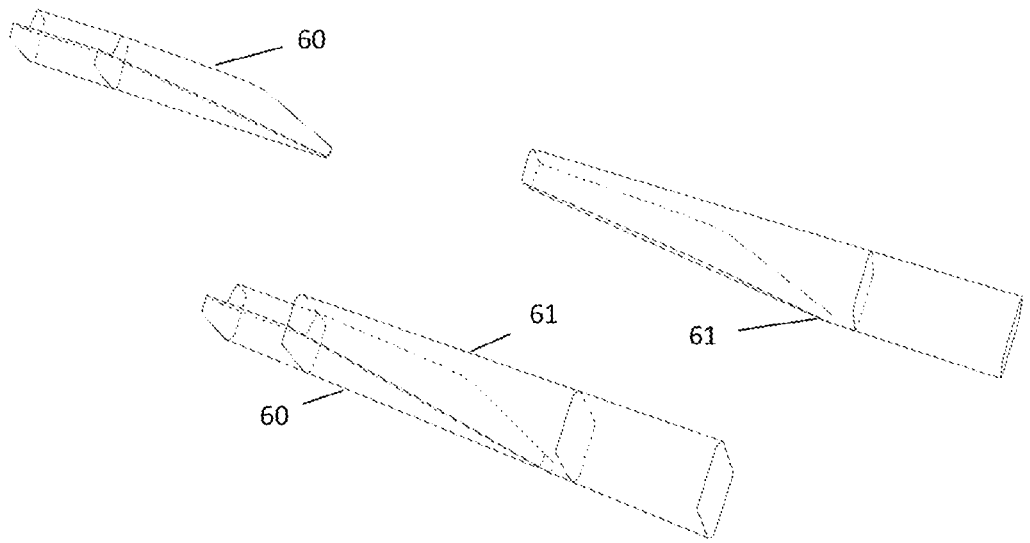
FIG. 7 schematically depicts an example of three-dimensional profiles of complementary tapered portions according to an embodiment of this disclosure.

In some embodiments, tapered portions 46 have the relatively planar configuration shown in FIG. 4 but if desired, more complex, three-dimensional profiles may also be used. For example, FIG. 7 schematically depicts alternative tapered portions 60 and 61 that have complementary groove and ridge configurations. They still taper over their longitudinal length so that a compressive longitudinal force creates the expansion force that locks the system together but feature the complementary groove and ridge to provide an additional dimension of engagement. As compared to a planar taper that relies only on collar 44 and friction between stacked tapered portions 46 to resist axial deflection, it will be appreciated that when tapered portions 60 and 61 are stacked the engagement between the complementary ridge and groove supplements the resistance to axial deflection. Other non-planar configurations are also within the scope of this disclosure.

Figure 8:
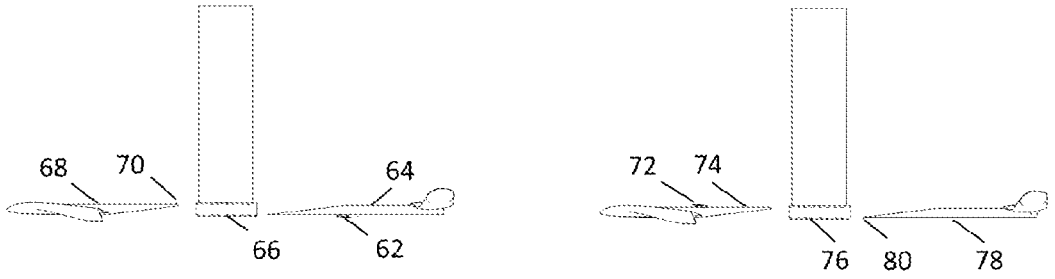
FIG. 8 schematically depicts alternative actuator configurations according to various embodiments of this disclosure.

Other suitable variations include the positioning of a clamping actuator to provide the desired longitudinal compression. In the embodiment shown in FIGS. 3 and 4, actuator 42 is positioned on rear fuselage 36 and engages fitting 50 or other feature of front fuselage 34. However, other exemplary embodiments are shown in FIG. 8. In the left-side view, actuator 62 is located on rear fuselage 64 and is configured to engage with collar 66. Front fuselage 68 has structural feature 70 that engages collar 66 and holds it in relative longitudinal position. Accordingly, even though engaging actuator 62 draws rear fuselage towards collar 66, the same effective longitudinal compression relative to front fuselage 68 is still achieved. The reverse configuration is shown in the right-side view, in which actuator 72 is located on front fuselage 74 to engage with and be drawn to collar 76 and rear fuselage 78 has a structural feature 80 to engage collar 76 and resist longitudinal motion. In both embodiments, the structural feature is first engaged with the collar and then the complementary fuselage portion is inserted to create the stacked configuration so that engagement of the actuator creates the longitudinal compression to secure the system together.

Figure 9:
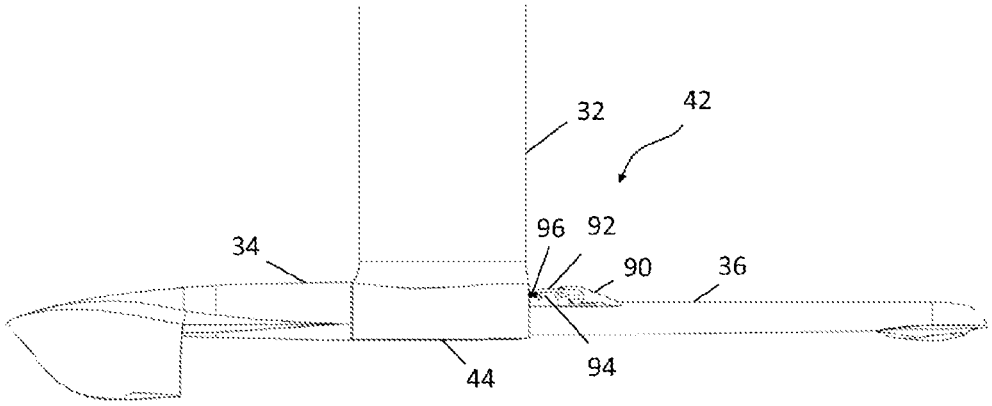
FIGS. 9 and 10 are respectively side and perspective views showing details of an actuator according to an embodiment of this disclosure.
Figure 10:
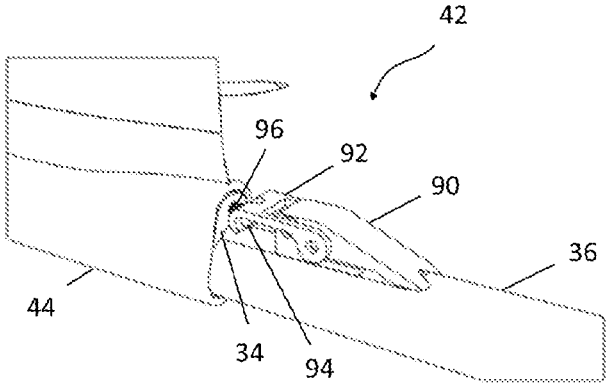
Figure 11:
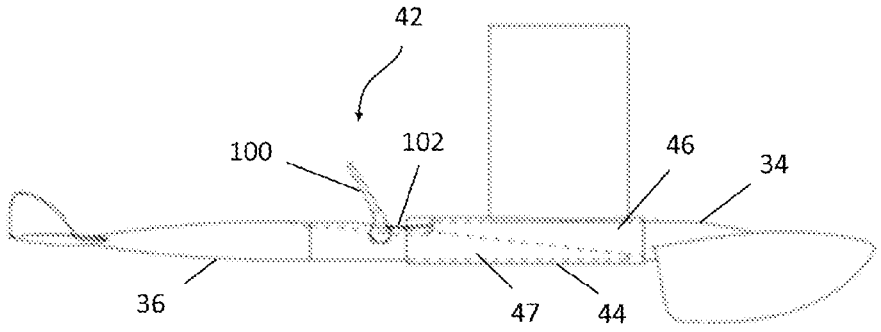
FIGS. 11 and 12 schematically depict alternative actuator implementations according to various embodiments of this disclosure.
Figure 12:
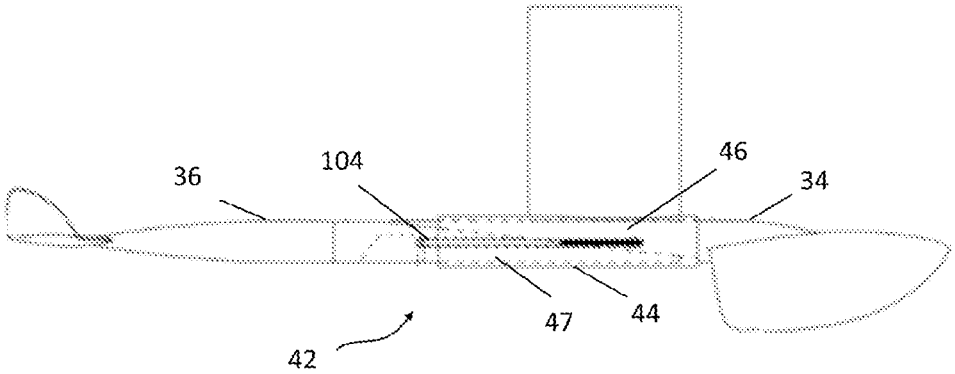

Illustrative implementations of actuator 42 are provided in FIGS. 9-12. For example, FIG. 9 is a side view and FIG. 10 is a perspective view of one embodiment of actuator 42. In particular, lever 90 is pivotally mounted on rear fuselage 36 and is operatively connected to hook 92 that engages the fitting of front fuselage 34, which here comprises bar 94 and connector 96. As desired, connector 96 may be threaded so that tension developed by lever 90 may be adjusted to account for wear, manufacturing tolerances or other factors. Lever 90 may be configured with an over center relationship so that the tension developed by lever 90 helps maintain it in the closed position that pulls front fuselage 34 towards rear fuselage 36. As another example, FIG. 11 is a side view, partially in section, that depicts an embodiment of actuator 42 in which lever 100 is operatively connected to line 102 that in turn is releasably attached to fitting 50 (not shown in this view). Closing lever 100 draws stacked tapered portions 46 and 47 (shown in phantom) together to frictionally lock the assembly within collar 44. Line 102 may be a wire or other suitable material that is relatively inelastic or may be somewhat resilient to facilitate maintaining compressive tension. Yet another example is shown in FIG. 12, also in a partial section side view, with actuator 42 implemented with rod 104 that engages screw threads in front fuselage 34. As with the other embodiments, tightening rod 104 draws front fuselage 34 and rear fuselage 36 together so that the stacked tapered portions 46 and 47 generate the expansion force that frictionally engages collar 44. It should be appreciated that other mechanisms and configurations may be employed to achieve similar functionality.

The various components may be formed using any suitable technique, such as injection molding, three-dimensional printing, computer number controlled (CNC) milling and others. Moreover, any suitable material can be employed. In some embodiments, composite materials are used that can optionally be reinforced by embedding components in a binder matrix. For example, the reinforcing components may be formed from fibers, fabrics or the like of any suitable material, including carbon, glass, boron, basalt, Nylon, Kevlar and the like. The binder matrix may be formed from suitable polymeric materials, including polyester and epoxy. The reinforcing members may be "wet out" or saturated with the polymer prior to curing to achieve desired structural characteristics. In some embodiments, the reinforcing member may have a three-dimensional structure such as a honeycomb configuration or the like. By employing such materials, the various hydrofoil components may exhibit increased structural integrity and can be adapted based on the expected forces. Moreover, avoiding the use of metals or alloys minimizes or eliminates the risk of corrosion. However, any or all the components of the hydrofoil assembly may also be formed from other materials, such as metal, alloys or others to create a component having sufficient structural strength.

Described herein are certain exemplary embodiments. However, one skilled in the art that pertains to the present embodiments will understand that the principles of this disclosure can be extended easily with appropriate modifications to other applications.

What is claimed is:

1. A hydrofoil system comprising:

a first fuselage portion having a tapered section;

a second fuselage portion having a tapered section;

a collar having an inner passageway dimensioned to encompass and retain the tapered section of the first fuselage portion and the tapered section of the second fuselage portion when overlapped in a stacked wedge configuration; and an actuator configured to draw the first fuselage portion and the second fuselage portion together longitudinally so that the collar frictionally engages the stacked tapered sections.

2. The hydrofoil system of claim 1, wherein the actuator comprises a manually-operated lever that imparts a force that pulls the first fuselage portion and second fuselage portion towards each other.

3. The hydrofoil system of claim 2, wherein a relative movement imparted to the first fuselage portion and second fuselage portion by the actuator is adjustable.

4. The hydrofoil system of claim 1, wherein the tapered section of the first fuselage portion and the tapered section of the second fuselage portion each have an equivalent length.

5. The hydrofoil system of claim 4, wherein the equivalent lengths of the tapered section of the first fuselage portion and the tapered section of the second fuselage portion are at least as long as a length of the collar passageway.

6. The hydrofoil system of claim 1, wherein a position of the stacked tapered sections is longitudinally adjustable within the collar.

7. The hydrofoil system of claim 1, wherein at least one of the first fuselage portion and the second fuselage portion comprises a hydrofoil wing.

8. The hydrofoil system of claim 7, wherein one of the first fuselage portion and the second fuselage portion comprises a fore wing and another of the first fuselage portion and the second fuselage portion comprises an aft wing.

9. The hydrofoil system of claim 1, wherein the actuator engages the first fuselage portion and the second fuselage portion.

10. The hydrofoil system of claim 1, wherein the actuator engages the collar and one of the first fuselage portion and the second fuselage portion and wherein the collar resists longitudinal movement of another of the first fuselage portion and the second fuselage portion.

11. The hydrofoil system of claim 1, wherein the tapered sections of the first fuselage portion and the second fuselage portion have a planar profile.

12. The hydrofoil system of claim 1, wherein the tapered sections of the first fuselage portion and the second fuselage portion have a three-dimensional profile.

13. The hydrofoil system of claim 1, wherein the actuator comprises a lever secured to one of the first fuselage portion and the second fuselage portion and wherein the lever is configured to apply tension to a line secured to another of the first fuselage portion and the second fuselage portion.

14. The hydrofoil system of claim 1, wherein the actuator comprises a threaded rod.

15. A fuselage portion for a hydrofoil system comprising a tapered section configured to overlap with a tapered section of another fuselage portion to form a stacked wedge such that the stacked tapered sections are configured to be retained by an inner passageway of a collar, wherein the fuselage portion further comprises at least one of actuator and a means for engaging an actuator, wherein the actuator is configured to draw the fuselage portion and the another fuselage portion together longitudinally.

16. The fuselage portion of claim 13, further comprising a hydrofoil wing.

17. A collar for a hydrofoil system comprising an inner passageway dimensioned to encompass and retain a tapered section of a first fuselage portion and a tapered section of the second fuselage portion when overlapped in a stacked wedge configuration.

18. A method for assembling a hydrofoil system comprising:

providing a first fuselage portion having a tapered section;

providing a second fuselage portion having a tapered section;

overlapping the tapered section of the first fuselage portion and the tapered section of the second fuselage portion in a stacked wedge configuration within a collar having an inner passageway; and drawing the first fuselage portion and the second fuselage portion together longitudinally so that the collar frictionally engages the stacked tapered sections.

19. The method of claim 18, wherein drawing the first fuselage portion and the second fuselage portion together comprises manually operating an actuator to impart a force that pulls the first fuselage portion and second fuselage portion towards each other.

20. The method of claim 18, wherein drawing the first fuselage portion and the second fuselage portion together comprises tightening a threaded connection.

* * * * *